US005785147A

United States Patent [19]

Lee

[11] Patent Number: 5,785,147

[45] Date of Patent: Jul. 28, 1998

[54] ESCAPE LADDER STRUCTURAL IMPROVEMENT

[76] Inventor: Kenten Lee, 5F, No. 8-37, Lung Hsing Rd., Pa Li, Taipei Hsien, Taiwan

[21] Appl. No.: 898,289

[22] Filed: Jul. 22, 1997

[51] Int. Cl.[6] ..... E06C 9/10

[52] U.S. Cl. ..... 182/70; 182/76; 182/84

[58] Field of Search ..... 182/70, 74, 73, 182/71, 76, 84, 95

[56] References Cited

U.S. PATENT DOCUMENTS

| | | | |
|---|---|---|---|
| 260,627 | 7/1882 | Townsend . | |
| 4,222,458 | 9/1980 | Pratt | 182/95 |
| 5,022,491 | 6/1991 | Gill | 182/70 |
| 5,303,799 | 4/1994 | Tsai | 182/70 |

*Primary Examiner*—Alvin C. Chin-Shue

*Attorney, Agent, or Firm*—Rosenberg, Klein & Bilker

[57] ABSTRACT

The subject invention relates to a type of escape ladder structural improvement (1), comprising a housing, an inside ladder, an outside ladder, an outside cover and a gear transmission; the hollow interior of the housing comprising an escape channel; the inside ladder, the outside ladder and the outside cover being respectively installed on the rear and front openings of the hollow interior in the housing; said inside ladder can swing backwards to extend itself by way of its own gravitational weight when a handle is pulled, and via the gear transmission mechanism, it in turn drives the outside cover and the outside ladder to swing forwards to extend themselves, so that the escapee will be able to climb the inside ladder, to the hollow interior of the housing, then to the outside ladder, and escape from the scene by means of the escape device on the outside cover; said mechanism will enable easy operation to create a best escape channel without causing bad effects on the appearance of a building.

6 Claims, 5 Drawing Sheets

ESCAPE LADDER STRUCTURAL IMPROVEMENT

BACKGROUND OF THE INVENTION

The subject invention relates to a type of escape ladder structural improvement (1), particularly to one type of escape ladder structural improvement that can be operated easily to provide a best escape channel and maintain the good-looking appearance of a building.

Conventionally, a prior art of escape ladder equipment, as disclosed in the R.O.C. Patent Gazette serial Nos. 248055, 227262, 198377, etc., is designed to assist people to escape safely from a hazardous location in times of fire of other emergencies. But said escape ladder has some problems—such as: its storage would adversely influence the appearance of a building; complicated procedures in actual operation; inability to be successfully extended and installed within a short period of time; in case the walls in a building are sealed, said type of escape ladder just could not be put to use, because there will be no way out.

It is obvious from the above that said prior art of escape ladder does have such inconveniences and disadvantages that need improvement.

Therefore, the subject inventor has devoted much time and intensive effort in the study of possible improvement on said disadvantages, with theoretical applications, and has presented the reasonably designed subject invention with effective improvement on said disadvantages.

The main purpose of the subject invention is to provide a type of escape ladder structural improvement (1), comprising a housing, said housing's hollow interior forming an escape channel, an inside ladder and an outside ladder, an outside cover respectively installed on the rear and front openings in the hollow interior of the housing; said inside ladder can swing backwards to extend, by controlling a handle as well as by its own gravitational force, and via the gear transmission mechanism to drive the outside cover and outside ladder to swing forwards to extend, so that the escapee can climb the inside ladder to the hollow interior in the housing, and to the outside ladder, and escape the scene via the escape device on the outside cover. The subject invention is so easy to operate that the inside ladder, the outside ladder and the outside cover can automatically extend to their positions, by means of their own gravitational force, to create a best escape channel, so that the chance for an escape can be obtained within a short period of time; its installation on the wall or such construction will form an additional escape channel, and when not in use, it can be stored inside the housing, so that it will not cause adverse effects on the appearance of a building.

The design approaches and functions employed in the subject invention to achieve the above purpose and configuration are described in details below with drawings of the preferred embodiment of the subject invention:

Figure 1:
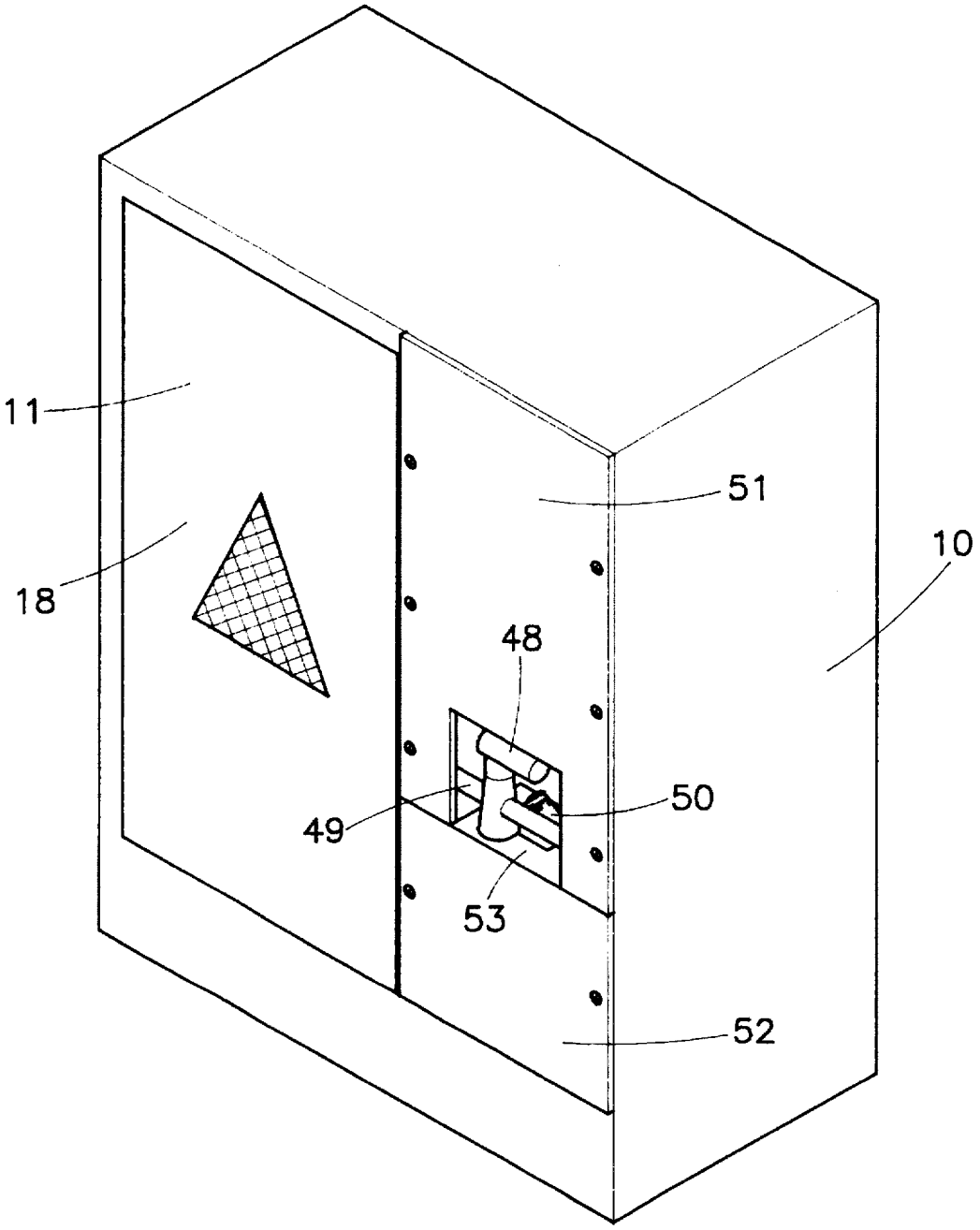
FIG. 1 is the exterior view of the subject invention.
Figure 2:
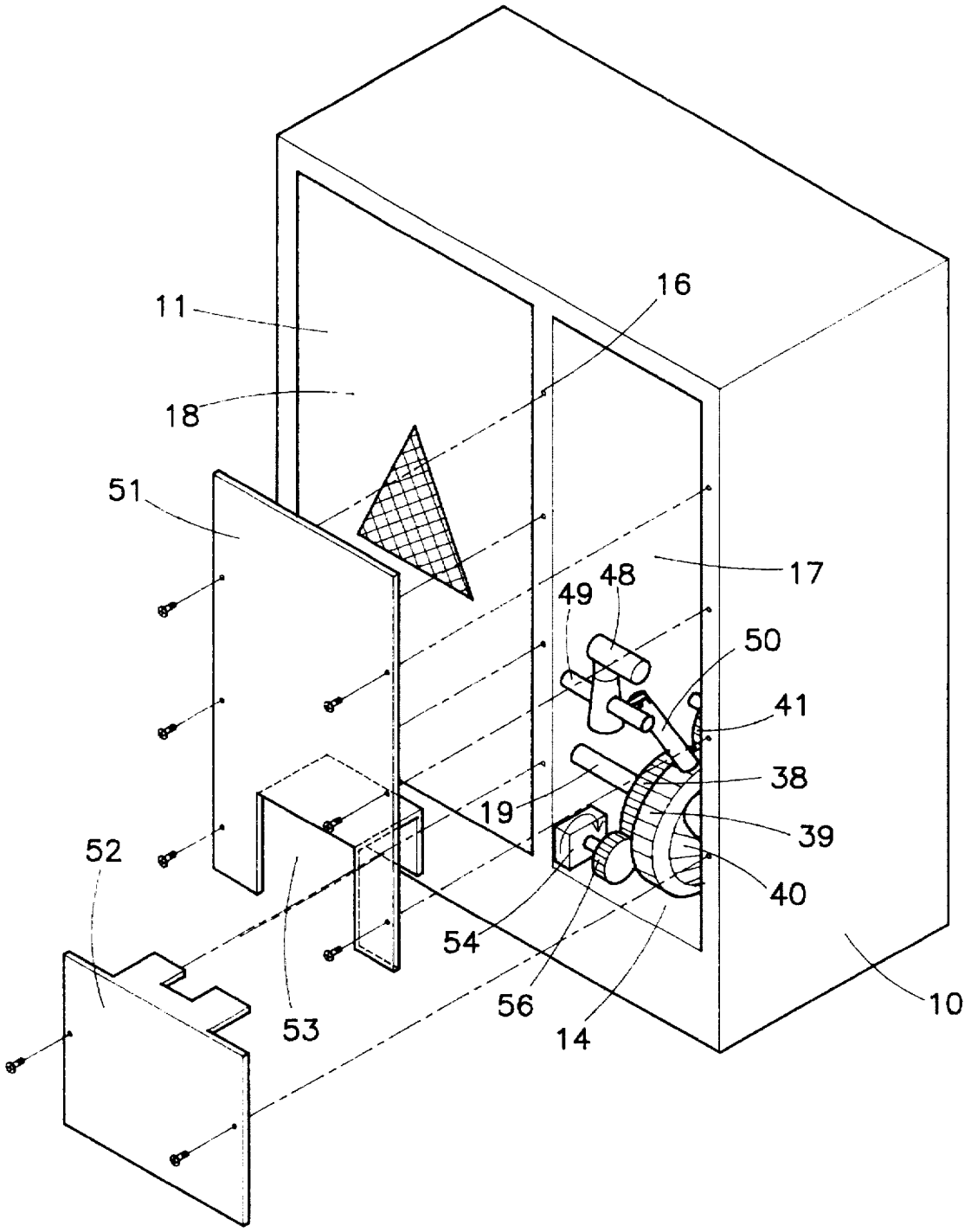
FIG. 2 is the exploded view of the subject invention.

| | |
|---|---|
| 10 housing | 11 inside ladder |
| 12 outside ladder | 13 outside cover |
| 14 gear transmission | 15 hollow interior |
| 16 partition board | 17 gear chamber |
| 18 plate body | 19 transmission shaft |
| 20 nonskid rack | 21 protruding shaft |
| 22 connecting rod | 23 hand bar |
| 24 plate body | 25 transmission shaft |
| 26 nonskid rack | 27 collapsible connecting rod |
| 28 plate body | 29 transmission shaft |
| 30 collapsible connecting rod | 31 lap joint |
| 32 lap joint | 33 slow descending equipment |
| 34 escape rope | 35 lower gear unit |
| 36 linked shaft | 37 upper gear unit |
| 38 spur gear | 39 spur gear |
| 40 bevel gear | 41 spur gear |
| 42 bevel gear | 43 bevel gear |
| 44 spur gear | 45 spur gear |
| 46 bevel gear | 47 shaft |
| 48 handle | 49 hinge |
| 50 catch lever | 51 cover plate |
| 52 cover plate | 53 vent hole |
| 54 generator | 55 generator |
| 56 spur gear | 57 spur gear |
| 58 alarm light | 59 alarm light |

DETAILED DESCRIPTION OF THE INVENTION

FIGS. 1, 2, 3 and 4 are respectively the exterior view, the exploded view, the side view and the perspective view of the subject invention in operation. The subject invention relates to the providing of a type of escape ladder structural improvement (1), comprising of such components as a housing 10, an inside ladder 11, an outside ladder 12, an outside cover 13 and a gear transmission unit 14; wherein the housing 10 is a hollow housing communicating to the front and the rear; said housing can be installed onto the wall or other appropriate locations of a building, so the hollow interior 15 of the housing 10 forms an escape channel; the hollow interior 15 of the housing 10 is separated by a partition board 16 to reserve a gear chamber 17.

Figure 3:
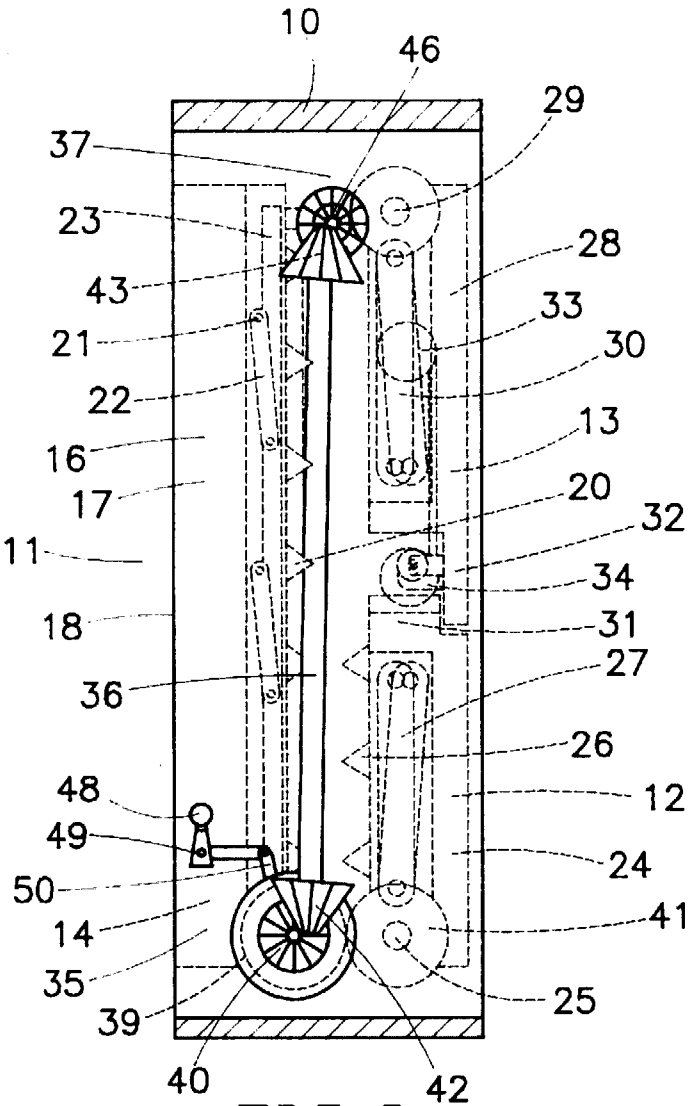
FIG. 3 is the side view of the subject invention.
Figure 4:
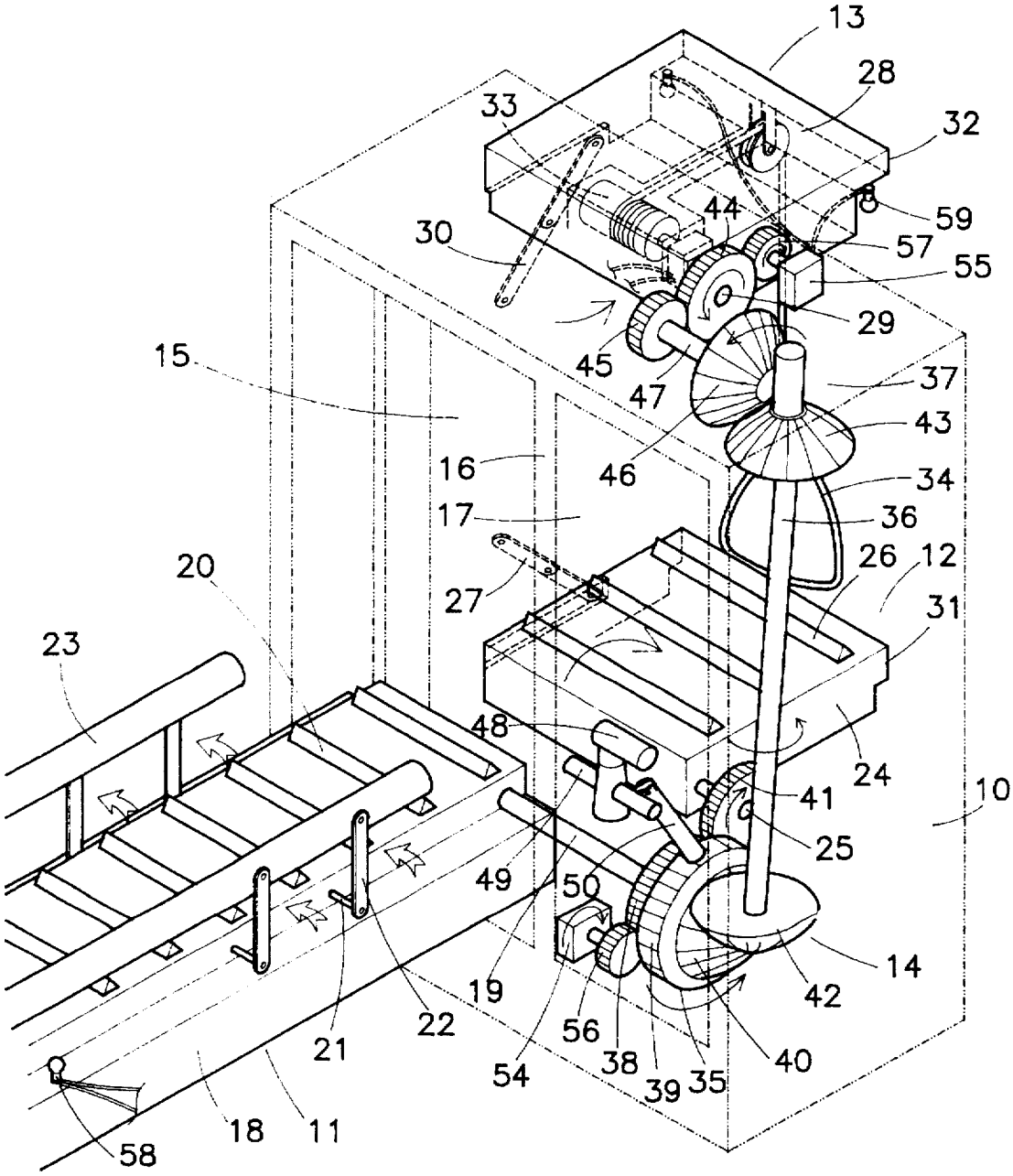
FIG. 4 is the perspective side view of the subject invention in actual operation.
Figure 5:
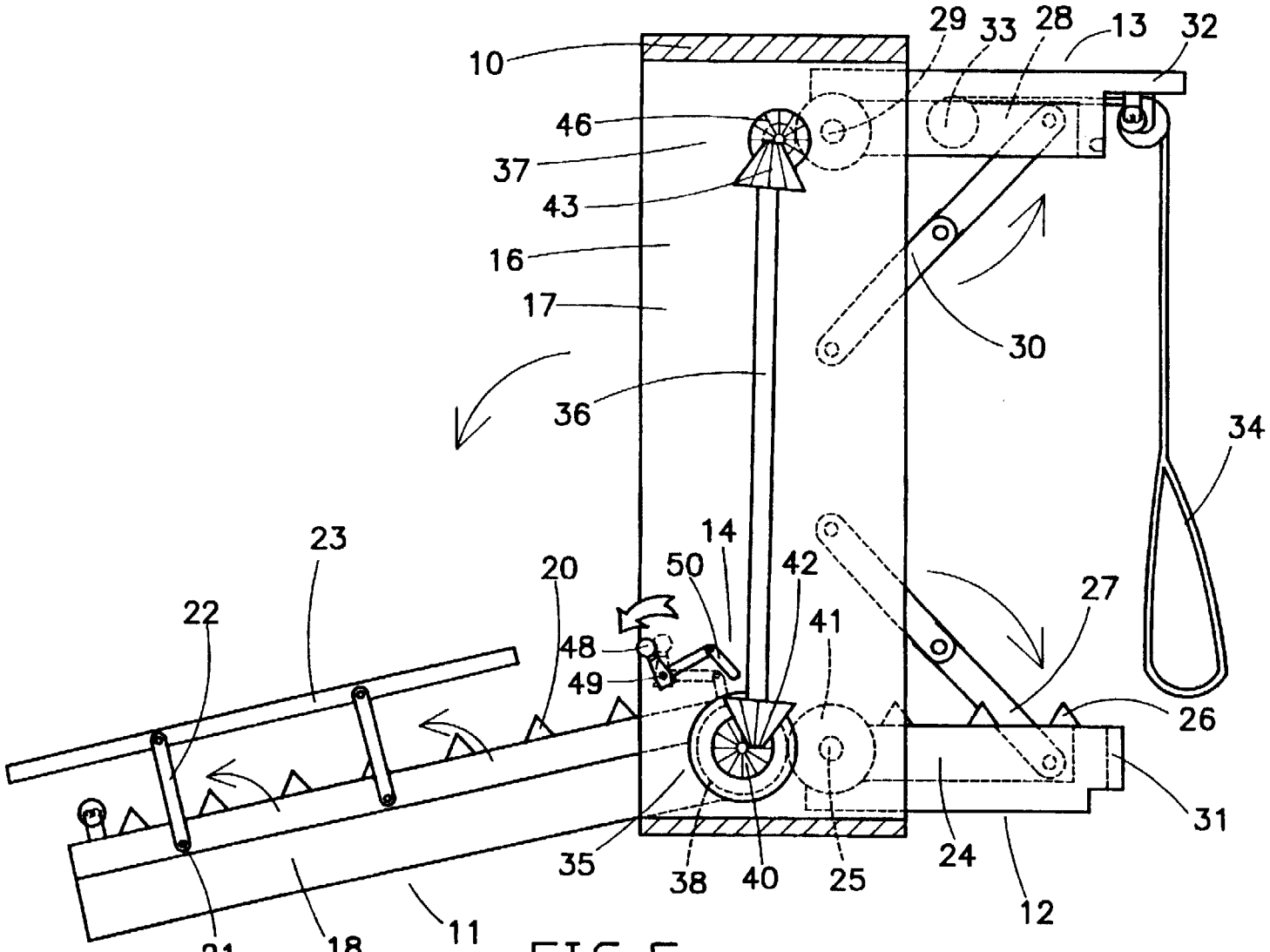
FIG. 5 is the perspective oblique view of the subject invention in actual operation.

The inside ladder 11 can be installed at the rear opening of the hollow interior 15 of the housing 10; said inside ladder 11 has a plate body 18; the bottom of the plate body 18 is joined to a transmission shaft 19; the transmission shaft 19 is fixed to the lower part of the two side walls of the hollow interior 15, so the inside ladder 11 is joined by the transmission shaft 19 to the housing 10; the inside ladder 11 can swing, with the transmission shaft 19 serving as its fulcrum, so that it can swing backwards to extend, or swing forwards to close the rear opening of the hollow interior 15. On the plate body 18 of the inside ladder 11 are fixed with several evenly spaced jutting nonskid bars 20; on two sides of the plate body 18 are protruding shafts 21; on the protruding shafts 21 are connecting rods 22; the connecting rods 22 on each side are joined to a hand bar 23. When the hand bar 23 is pushed to move forwards, the upper ends of the connecting rods swing forwards, so the hand bar 23 is lowered to rest on the protruding shafts 21 (as illustrated in FIG. 3). When the hand bars 23 are moved backwards, the upper ends of the connecting rods 22 swing backwards, so the hand bars 23 rise and extend to one side of the plate body 18 (as illustrated in FIGS. 4 and 5).

The outside ladder 12 can be installed on the lower part of the front opening of the hollow interior 15 in the housing 10; said outside ladder 12 has a plate body 24; the bottom part of the plate body 24 is fixed to a transmission shaft 25; the transmission shaft 25 is joined to the lower part of the two side walls of the hollow interior 15, so the outside ladder 12 is joined by the transmission shaft 25 to the housing 10; the outside ladder 12 can swing forwards, with the transmission shaft 25 serving as the fulcrum, to extend, or swing backwards to close the lower part of the front opening of the hollow interior 15. On the plate body 24 of the outside ladder 12 are several evenly spaced jutting nonskid bars 26; between one side of the plate body 24 and the inside wall of the hollow interior 15 is connected with a collapsible connecting rod 27; so that when the outside ladder 12 swings forwards to extend, it will stretch the outside ladder 12 to be positioned at an appropriate angle; the upper part of the plate body 24 of the outside ladder 12 forms a lap joint 31.

The outside cover 13 can be installed on the upper part of the front opening of the hollow interior 15 in the housing 10; said outside cover 13 has a plate body 28; the top of the plate body 28 is fixed to a transmission shaft 29; the transmission shaft 29 is installed on the upper part on two side walls of the hollow interior 15, so the outside plate 13 is joined by the transmission shaft 29 to the housing 10; the outside cover can swing forwards to extend, with the transmission shaft 29 serving as a fulcrum, or swing backgrounds to close the upper part of the front opening of the hollow interior 15. Between one side of the plate body 28 and the inside wall of the hollow interior 15 is connected with a collapsible connecting rod 30 that will restrict the outside cover 13 to be positioned at an appropriate angle when the outside cover 13 moves forwards to extend. The lower part of the plate body 28 of the outside cover 13 forms a lap joint 32; when the outside cover 13 swings backwards to close the upper part of the front opening of the hollow interior 15, the lap joint 32 at the lower part of the plate body 28 of said outside cover 13 can be joined to the lap joint 31 on the upper part of the plate body 24 of the outside ladder at the lower part of the front opening of the closed hollow interior 15. On the plate body 28 of the outside cover 13 is fitted with the escape device of a slow descending equipment 33 and other parts; said slow descending equipment 33 has an escape rope 34 that can be descended slowly.

The gear transmission mechanism 14 is installed in the gear chamber 17 in the housing 10, and partially installed in the hollow interior 15; the gear transmission 14 comprises a lower gear unit 35, a linked shaft 36 and an upper gear unit 37; said lower gear unit 35 comprises a spur gear 38 that is fitted on the transmission shaft 19 of the inside ladder 11; said transmission shaft 19 is fitted with another spur gear 39 and a bevel gear 38; the transmission shaft 25 of the outside ladder 12 is fitted with a spur gear 41; said spur gear 41 is connected with the spur gear 38 on the transmission shaft 19 of the inside ladder 11; the linked shaft 36 is fitted in the gear chamber 17; the lower part of the linked shaft 36 is fitted with a bevel gear 42; said bevel gear 42 is connected with the bevel gear 40 on the transmission shaft 19 of the inside ladder 11.

Said upper gear unit 37 comprises a spur gear 44 that is fixed to the transmission shaft 29 of the outside cover 13; the spur gear 44 is connected with another spur gear 45; said spur gear 45 and a bevel gear 46 are fixed to a shaft 47; said shaft 47 is fixed on the partition board 16 on the housing 10; the upper part of the linked shaft 36 is fitted with a bevel gear 43; said bevel gear 43 is connected with a bevel gear 46 on the shaft 47. On the side of the lower gear unit 35 is a handle 48; said handle 48 is supported by a shaft 49 in the gear chamber 17; the lower part of the handle 48 is connected to a catch lever 50; said catch lever 50 can be mounted on the toothed rim of a spur gear 39 on the lower gear unit 35, to arrest the gear transmission unit 14.

When the subject invention is not in use (as in FIGS. 1, 2 and 3), the upper part of the inside ladder 11 swings forwards to close the rear opening of the hollow interior 15; the lower part of the outside cover 13 swings backwards to close the upper part of the front opening of the hollow interior 15; and the lap joint 32 of the outside cover 13 rests on the lap joint 31 of the outside ladder 12; then, the hollow interior 15 of the housing 10 is in a closed status, and the inside ladder 11, the outside ladder 12 and the outside cover 13 are stored inside the housing 10. On the front and rear of the gear chamber 17 in the housing can be fixed with cover plates 51, 52 to properly seal it; and an appropriate vent hole is reserved between the rear of the gear chamber 17 and the cover plate 52, to facilitate operation of the handle 48.

Referring to FIG. 5 which is the side view of the subject invention in actual application, when the subject invention is used for escaping purpose, the escapee can pull back the handle 48 inside a building room (the rear of the housing 10), so the handle 48 will move the catch lever 50 upwards with the shaft 49 serving as the fulcrum, so the catch lever 50 is disengaged from the spur gear 39 on the lower gear unit 35, and the gear transmission 14 will start to rotate; because the force of the catch on the lower gear unit 35 is removed, the inside ladder 11 will swing by its own gravitational force, with the transmission shaft 19 at the lower part of the inside ladder serving as its fulcrum, to swing backwards to extend; now the inside ladder 11 is inclined; and when the inside ladder 11 swings backwards to extend, the transmission shaft 19 will simultaneously drive the spur gears 38, 39 and the bevel gear 40 to rotate; the bevel gear 40 will drive the bevel gear 42 on the lower part of the linked shaft 36, as well as the bevel gear 43 on the upper part of the linked shaft 36, to rotate; the bevel gear 43 will drive the transmission shaft 29 on the outside plate 13 to rotate, sequentially through the bevel gear 46, the shaft 47 and the spur gears 45, 44; so the outside cover 13 moves forwards to extend to a horizontal status; at the same time when the spur gear 38 is rotating, it drives the spur gear 41 to rotate; which in turn drives the transmission shaft 25 on the outside ladder 12 to rotate; so the outside ladder 12 swings forwards to extend to a horizontal status. When the inner ladder 11, the outer ladder 12 and the outer cover 13 extend to their positions, the escapee can climb the inside ladder 11 to the hollow interior 15 in the housing 10 to the outside ladder 12, and out of the hazardous location by means of the slow descending equipment 33 and other escape devices on the outside cover 13.

The subject invention is quite easy to operate. Merely by one simple operation of pulling the handle 48, then, the inside ladder 11, the outside ladder 12 and the outside cover 13 will automatically extend to their positions, by means of their own gravitational force, to form an excellent escape channel. Its simple operational procedures enable rapid extension and installation of the escape ladder in a very short period of time, to gain sufficient time for the escape, thus minimizing casualties. The subject invention can be installed on the wall or other appropriate locations in a building to produce an additional escape channel. When not in use, the subject invention can be stored inside the housing 10, so there is no worry of bad effects on a building's appearance.

Furthermore, on the sides of the lower gear unit 35 and the upper gear unit 37 of the gear transmission mechanism 14 can be installed respectively with generators 54 and 55; the spur gears 56, 57 of said generators 54, 55 are connected with the spur gear 38 of the lower gear unit 35 and the spur gear 44 of the upper gear unit 37; when the lower gear unit 35 and the upper gear unit 37 rotate, they will drive the spur gears 56, 57 of the generators 54, 55 to rotate simultaneously; so the generators 54, 55 will produce power; said generators 54, 55 are connected with appropriate conductive wires to the alarm lights 58, 59 that are installed on the inside ladder 11 and the outside cover 13; so that when the subject invention is in operation, the alarm lights 58, 59 will emit light.

Summing up, the subject invention is an unprecedented invention with improvement on such disadvantages of conventional escape ladders as bad effects on a building's appearance, complicated operational procedures, etc. With such novelty and originality that will fully satisfy the requirements for the application for a patent, this application is filed in accordance with the Patent Law to protect the subject inventor's rights and interests. Your favorable consideration should be appreciated.

It is hereby declared that the above invention, covering only the preferred embodiment of the subject invention, should not be based to limit or restrict the subject claim, and that all equivalent variations deriving from the subject description and contents in the drawings should reasonably be included in the intent and claim of the subject invention.

I claim:

1. A type of escape ladder structural improvement (1), comprising:

a housing, being a hollow housing that can be fixed at an appropriate location in a building; the hollow interior of the housing comprising an escape channel; one side of the housing's hollow interior comprising a gear chamber; the front and rear sides of the gear chamber can be properly sealed, reserving an appropriate vent hole at the rear of the gear chamber;

an inside ladder, comprising a plate body; on the lower part of the plate body being a transmission shaft; the transmission shaft being fixed onto the two side walls inside the hollow interior; the inside ladder can extend backwards or forwards to close the rear opening of the hollow interior with the transmission shaft serving as its fulcrum;

an outside ladder, comprising a plate body; on the lower part of the plate body being a transmission shaft; the transmission shaft being fixed onto the two side walls inside the hollow interior; the outside ladder can extend forwards or backwards to close the lower part of the front opening of the hollow interior, with the transmission shaft serving as its fulcrum; between one side of the plate body and the inside wall of the hollow interior being connected with a collapsible connecting rod;

an outside cover, comprising a plate body; on the upper part of the plate body being a transmission shaft; the transmission shaft being fixed on the two side walls in the hollow interior; the outside cover can extend forwards or backwards to close the upper part of the front opening of the hollow interior with the transmission shaft serving as its fulcrum; between one side of the plate body and the inside wall of the hollow interior being connected with a collapsible connecting rod; on the plate body of the outside cover being a slow descending equipment and such escape devices; and a gear transmission mechanism, installed in the gear chamber of the housing, comprising a lower gear unit, a linked shaft and an upper gear unit; said lower gear unit being connected with the transmission shafts of the inside ladder and the outside ladder; the lower gear unit being connected with the upper gear unit through the linked shaft; said upper gear unit being connected with the transmission shaft of the outside cover; on the side of the lower gear unit being fitted with a handle; the handle being supported by a shaft in the gear chamber; the lower part of the handle being connected with a catch lever; the catch lever can be positioned at the lower gear unit, so the gear transmission will not rotate.

By pulling the handle of the gear transmission mechanism, the catch lever is disengaged from the lower gear unit, so the gear transmission can rotate, and the inside ladder can swing backwards to extend by its own gravitational force, and via the gear transmission mechanism, the outside cover and the outside ladder will swing forwards to extend, so that the escapee will be able to climb the inside ladder, to the hollow interior of the housing and to the outside ladder, and out of the scene by means of the escape device on the outside cover.

2. The escape ladder structural improvement (1), as recited in claim 1, wherein the plate body on the inside ladder are fitted with several jutted nonskid bars that are evenly spaced.

3. The escape ladder structural improvement (1), as recited in claim 1, wherein the two sides of the plate body of the inside ladder are fitted with protruding shafts, the protruding shafts are linked to connecting rods, and the connecting rod on each side is linked to a hand bar.

4. The escape ladder structural improvement (1), as recited in claim 1, wherein on the plate body of the outside ladder are several jutted nonskid bars that are evenly spaced.

5. The escape ladder structural improvement (1), as recited in claim 1, wherein the upper part of the plate body of the outside ladder forms a lap joint, the lower part of the plate body of the outside cover forms a lap joint, the lap joint of the outside cover can be connected to the lap joint of the outside ladder.

6. The escape ladder structural improvement (1), as recited in claim 1, wherein on the sides of the lower gear unit and upper gear unit in the gear transmission can have generator units; said generator units are connected with the lower gear unit and the upper gear unit; when the lower gear unit and the upper gear unit rotate, they will drive the generators to produce electric power; said generators are connected with appropriate conductive wires to the alarm lights on the inside ladder and the outside cover.

* * * * *